US006364244B1

(12) United States Patent
Pasquale et al.

(10) Patent No.: US 6,364,244 B1
(45) Date of Patent: Apr. 2, 2002

(54) AUTOMATIC TWO-PLY WEB SPLICER

(75) Inventors: Robert A. Pasquale, Hawthorne; Frank P. Lembo, Ramsey, both of NJ (US)

(73) Assignee: New Era Converting Machinery, Inc., Patterson, NJ (US)

( * ) Notice: Subject to any disclaimer, the term of this patent is extended or adjusted under 35 U.S.C. 154(b) by 0 days.

(21) Appl. No.: 09/495,038

(22) Filed: Jan. 31, 2000

(51) Int. Cl.[7] ..... B65H 19/18
(52) U.S. Cl. ..... 242/554.6
(58) Field of Search ..... 242/520, 522, 242/526, 526.3, 527, 527.2, 550, 551, 554, 554.5, 554.6, 556.1; 156/502, 504

(56) References Cited

U.S. PATENT DOCUMENTS 4,363,695 A * 12/1982 Marass ..... 156/504
5,472,755 A * 12/1995 Nibling, Jr. ..... 428/40
5,698,060 A * 12/1997 Long ..... 156/304.3

* cited by examiner

*Primary Examiner*—Donald P. Walsh
*Assistant Examiner*—Mark J. Beauchaine

(74) *Attorney, Agent, or Firm*—Morrison Law Firm

(57) ABSTRACT

The severed trailing edge of a two-ply web is spliced to a leading edge of a replacement web on a replacement roll in a two-part operation which permits on-the-fly splicing. The upper ply of the replacement web is trimmed back to reveal a strip of the lower ply. A splice tape is placed under the edge of the lower ply with a portion of the splice tape exposed. A splice roll is prepared with a splice sheet having first and second adhesive strips spaced apart on it. The replacement roll and splice roll are accelerated to synchronize their peripheral speeds with the web speed. The rotational phases of the replacement roll and splice roll are coordinated. A bump roll is triggered to urge the web against the replacement roll. A cut-off knife is triggered to sever the web. The bump roll and cut-off knife trigger are timed so that the trailing edge of the severed web falls into contact with the exposed portion of the splice tape. This splices the lower plies together. The splice roll is urged into contact with the web at a rotational phase and a timining effective to adhere the first adhesive strip to the upper ply of the web downstream of the splice and the second adhesive strip to the upper ply upstream of the splice with the splice sheet bridging the gap between the first and second adhesive strips. The completed splice of lower to lower and upper to upper plies permits independent subsequent handling, separation, etc. of the first and second plies.

5 Claims, 9 Drawing Sheets

10
12
14
26
28
30
32
42
44
64
72
11
11'
12'
13'

AUTOMATIC TWO-PLY WEB SPLICER

BACKGROUND

Converting machinery falls into two categories, winders and unwinders. In a winder, a high-speed incoming web is wound onto a roll until the roll is filled. During winding, a core for winding a new roll is brought into position to continue winding the incoming web. The problem then is to transfer the winding from the completed roll to the new core by terminating winding on the original roll, and beginning winding on the core for the new roll. Originally the transfer was made by stopping the web, cutting the web, and affixing the leading edge of the web to the core using, for example a strip of adhesive tape. Upon completion of this transfer, the web was restarted. This procedure is called zero-speed transfer.

In an unwinder, a roll feeds an outgoing web. During unwinding, a filled roll is brought into position to assume the feeding role as the original roll is depleted. The problem of transfer from one roll to the next is the same as for the winder discussed above.

Filled rolls of, for example, newsprint, are large and heavy. Some such rolls weigh several tons. Stopping and starting heavy rolls for zero-speed splicing imposes a heavy time delay. This time delay has a serious impact on productivity.

In the case where the process feeding the winder, or the process receiving web from the unwinder, is a continuous process, a problem arises in interfacing a start-stop winding/unwinding process with a continuous feeding or receiving process.

The prior art discloses techniques for on-the-fly joining of the end of a web feeding a building roll in a winder, or being fed from a feeding roll in an unwinder. In an example of a web being wound on a succession of rolls, a core for a new roll is moved into position adjacent the moving web. A strip of adhesive tape is disposed along the core. The core is rotated up to a speed that is synchronous with the moving web. At the appropriate time, a knife is fired into the moving web to sever it. A bump roll is triggered to press the severed leading edge of the web into contact with the adhesive tape on the rotating core. Winding then continues, unabated, on the core. Since the peripheral speeds of the core and the incoming web are equal, the transfer takes place without disruption in web flow.

In an unwinder, the leading edge of the replacement roll receives adhesive tape. The replacement roll is accelerated to match its peripheral speed with that of the web passing thereby. At the appropriate time, a knife is fired to sever the web from the depleting roll, and a bump roll is fired to press the trailing edge of the severed web onto the adhesive tape on the leading edge of the replacement roll. As in the case of the winder discussed above, the supply of web continues unabated from the replacement roll.

A different problem is evidenced when it is desired to splice a two-ply web. As will be seen from the detailed description of the present invention, it is not sufficient to merely cut and splice the leading edge of the web from the replacement to the trailing end of the web from the depleting roll. A two-ply web may include, for example, a protective liner which carries a web of interest. For proper joining, the leading edge of the incoming liner must be spliced to the trailing edge of the outgoing liner, and the leading edge of the web of interest must be spliced to the trailing edge of its counterpart on the outgoing material. The inventors are unaware of any system which permits splicing a two-ply web on the fly. Instead, the prior art requires that the web be stopped for a zero-speed manual splice, with the disadvantages of zero-speed splicing discussed above.

OBJECTS AND SUMMARY OF THE INVENTION

Accordingly, it is an object of the invention to provide a splicing technique which overcomes the drawbacks of the prior art.

It is a further object of the invention to provide a splicing technique which permits the splicing of a two-ply web on the fly.

Briefly stated, the present invention provides a splicing apparatus and method in which the severed trailing edge of a two-ply web is spliced to a leading edge of a replacement web on a replacement roll in a two-part operation which permits on-the-fly splicing. The upper ply of the replacement web is trimmed back to reveal a strip of the lower ply. A splice tape is placed under the edge of the lower ply with a portion of the splice tape exposed. A splice roll is prepared with a splice sheet having first and second adhesive strips spaced apart on it. The replacement roll and splice roll are accelerated to synchronize their peripheral speeds with the web speed. The rotational phases of the replacement roll and splice roll are coordinated. A bump roll is triggered to urge the web against the replacement roll. A cut-off knife is triggered to sever the web. The bump roll and cut-off knife trigger are timed so that the trailing edge of the severed web falls into contact with the exposed portion of the splice tape. This splices the lower plies together. The splice roll is urged into contact with the web at a rotational phase and a timing effective to adhere the first adhesive strip to the upper ply of the web downstream of the splice and the second adhesive strip to the upper ply upstream of the splice with the splice sheet bridging the gap between the first and second adhesive strips. The completed splice permits independent subsequent handling, separation, etc. of the first and second plies.

According to an embodiment of the invention, there is provided a web splicer for on-the-fly splicing of a leading edge of a replacement web with a web comprising: the replacement web being wound on a replacement roll movable into a position spaced from a first surface of the web, a bump roll at a second surface of the web, a cut-off knife, means for matching a speed of a peripheral surface of the replacement roll with a speed of the web, means for urging the bump roll into contact with the web, and for severing the web, at a timing whereby urging the web into contact with the replacement roll affixes a splice tape at a trailing end of the web, where severed, injoining contact with the first surface of a leading edge of the replacement web, whereby a first surface of the web is spliced to a first surface of the replacement web, a splice roll, the splice roll being adapted for the attachment thereto of a splice sheet with first and second spacedapart adhesive strips affixed thereto, means for urging the splice roll into contact with the web, and means for controlling a rotational speed and a phase of the splice roll, with respect to the replacement roll, and a timing of urging the splice roll into contact with the web, to affix the first adhesive strip to the web downstream of the trailing edge, and to affix the second adhesive strip to the web upstream of the leading edge, with the splice sheet bridging a gap between the first and second adhesive strips, whereby first and second sides of the web are spliced to corresponding sides of the replacement web.

According to a feature of the invention, there is provided apparatus for splicing a replacement web to a web, wherein the web and the replacement web each includes first and second plies comprising: first means for splicing the first ply of the web and the replacement web together, second means for splicing the second ply of the web and the replacement web together, the second means being disposed downstream of the first means, and the first means and the second means being operable to perform the splicing while the web is in motion, whereby processing speed of the web is improved.

According to a further feature of the invention, there is provided a method for splicing a replacement web on a replacement roll to a moving web, wherein the replacement web and the web both include first and second plies, comprising: preparing a leading edge of the replacement web by trimming back an outermost portion of the second ply, which exposes an upper surface of the first ply, fixing a strip of splice tape partly below the first ply, and partly uncovered by the first ply, whereby an adhesive portion of the stirrip is exposed, preparing a web splice by affixing first and second adhesive strips spaced apart on a splice sheet, affixing, the web splice to a splice roller adjacent the moving web, with the first and second adhesive strips facing outward, accelerating the replacement roller to a peripheral speed substantially matching a speed of the moving web, urging the web against the replacement roller, and severing the moving web at a time effective for affixing the strip of splice tape to a severed trailings edge of the web, whereby the first ply of the web is spliced to the first ply of the replacement web, accelerating the splice roller to a peripheral speed substantially matching a speed of the moving web, adjusting a rotational phase of the splice roller, urging the splice roller into contact with the web at a timing which affixes the first adhesive strip downstream of the trailing edge and affixes the second adhesive strip upstream of the leading edge, with the splice sheet bridging a space between the first and second adhesive strips, whereby the second plies of the web and the replacement web are spliced to each other.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

In the following description, conventional elements in a winder/unwinder apparatus are omitted since such elements are well known to those skilled in the art. Such elements include rotating turrets, motor drives, spindles, etc.

Figure 1:
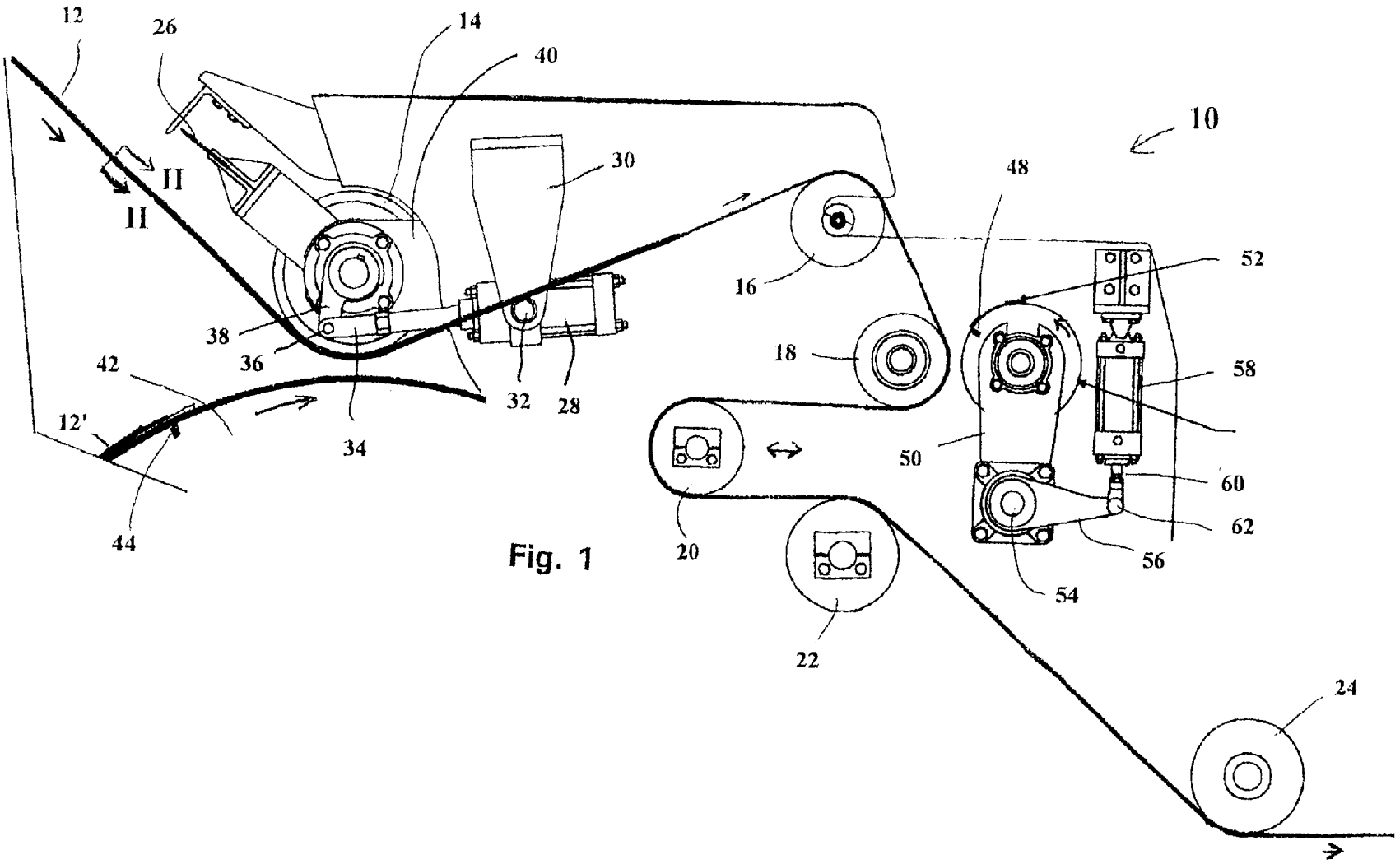
FIG. 1 is a schematic view of a splicer according to an embodiment of the invention.

Referring to FIG. 1, there is shown, generally at 10, relevant portions of a two-ply web splicer to which reference will be made in describing the present invention. For present purposes, a two-ply web 12, from any convenient source such as, for example, a roll (not shown), enters the vicinity of splicer 10.

Figure 2:
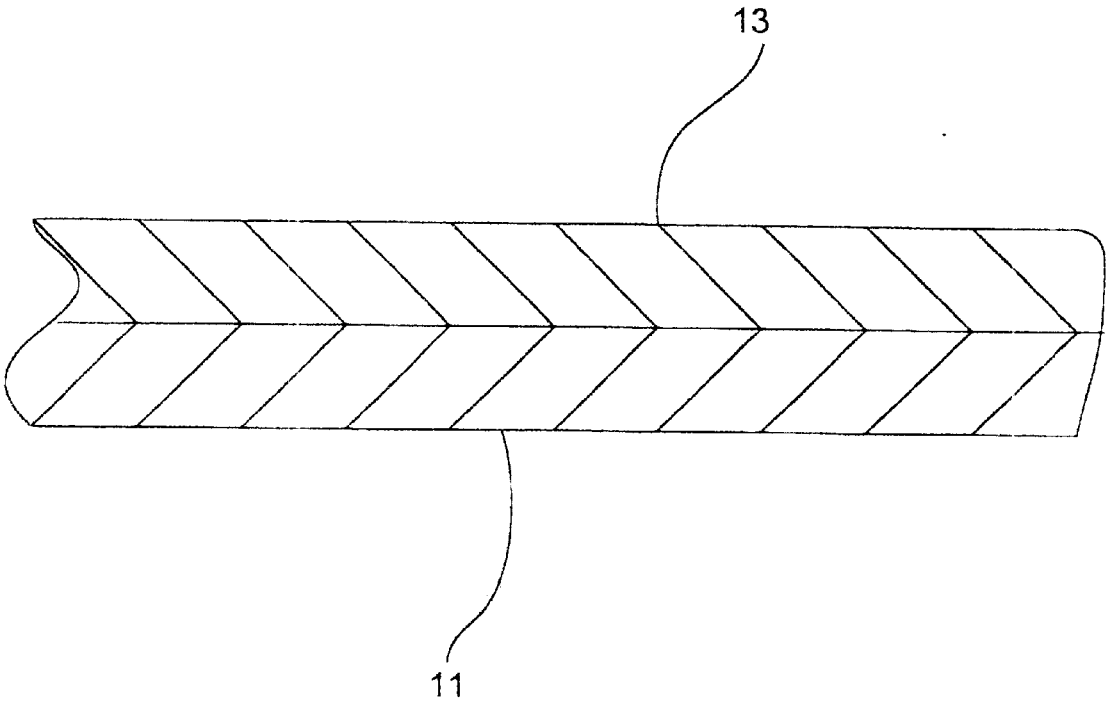
FIG. 2 is a cross section taken along II—II FIG. 1.

Referring now momentarily to FIG. 2, web 12 includes, for example, a liner 11 and a top web 13.

Returning now to FIG. 1. splicer 10 is shown in the normal running condition of feeding web 12 therethrough in the absence of a splicing operation, which will be described later. Web 12 passes over a bump roller 14 and an idler roller 16 on its way to a splicer back-up roller 18. After splicer back-up roller 18, web 12 passes over a tensioning roller 20 and idler rollers 22 and 24 before exiting splicer 10 to a using operation (not shown). The using operation may be, for example a separating operation in which the two plies are separated and wound on separate rollers. As is conventional, tensioning roller 20 is movable back and forth in the direction of the double-headed arrow adjacent thereto to maintain substantially constant tension on web 12. Since tensioning roller 20, and the apparatus for adjusting its position are both well known to those skilled in the art, further description thereof is hereby omitted.

A cut-off knife 26 is disposed for rotation about the axis of bump roller 14. A pneumatic cylinder 28 is affixed to a support 30 through a pivot 32. A piston rod 34 is connected through a pivot 36 to a knife actuating arm 38. The axis of bump roll 14, and cut-off knife 26, is mounted on a bump-roll arm 40. A conventional pneumatic cylinder (hidden in FIG. 1) controls movement of bump roll arm 40 and thus of bump roll 14 and knife 26 toward a replacement roll 42.

Replacement roll 42 has been prepared and moved into position spaced from bump roll 14. A replacement roll leading edge marker 44 is affixed at a known relationship to a leading edge of a new web 12', which, at the proper time, will be spliced to the end of expiring web 12. Leading edge marker 44 is, in practice, affixed to an element such as, for example, a shaft or chuck which rotates with replacement roll 42, for purposes of description, it is shown near the perimeter of replacement roll 42. Leading edge marker 44 may be part of any convenient type of sensing system which can sense its passage for purposes of controlling the operation of splicer 10. For example, leading edge marker 44 may employ magnetic or radio sensing but, in the preferred embodiment, leading edge marker is a retroreflective stripe the passage of which can be sensed by an electro-optical sensor (not shown). Such electro-optical sensors, such as well-known conventional ones manufactured by Texas Instruments, are integrated units employing an infra-red or visible light source and an optical detector in a single enclosure with all required optics. The optical detector produces an output pulse each time the marker passes its field of view.

A splicer roll 46 is positioned with its perimeter spaced from the perimeter of splicer back-up roll 18. Splicer roll 46 is driven at a controlled speed by a motor 47. Splicer roll 46 includes a splicer leading edge marker 48. Splicer leading edge marker 48 may be the same type as leading edge marker 44. A marker sensor, not shown, detects the passage of splicer leading edge marker 48 to produce a timing signal which will be used in controlling the operation of splicer 10, as will be explained below. The technology for sensing splicer leading edge marker 48 may be the same as, or different from the technology for sensing leading edge marker 44 on replacement roll 42. A web splice 52 is affixed to splicer roll 46 in known rotational relationship to splicer leading edge marker 48.

Splicer roll 46 is mounted at an upper end of a splicer roll support arm 50. Splicer roll support arm 50 is rotatable about a pivot 54 at its lower end. A crank arm 56 is attached to rotate splicer roll support arm 50 about pivot 54. A splicer pneumatic cylinder 58 is affixed at one end to the frame of splicer 10. A piston rod 60 of pneumatic cylinder 58 is connected at a pivot 62 to an outer end of crank arm 56.

Figure 3:
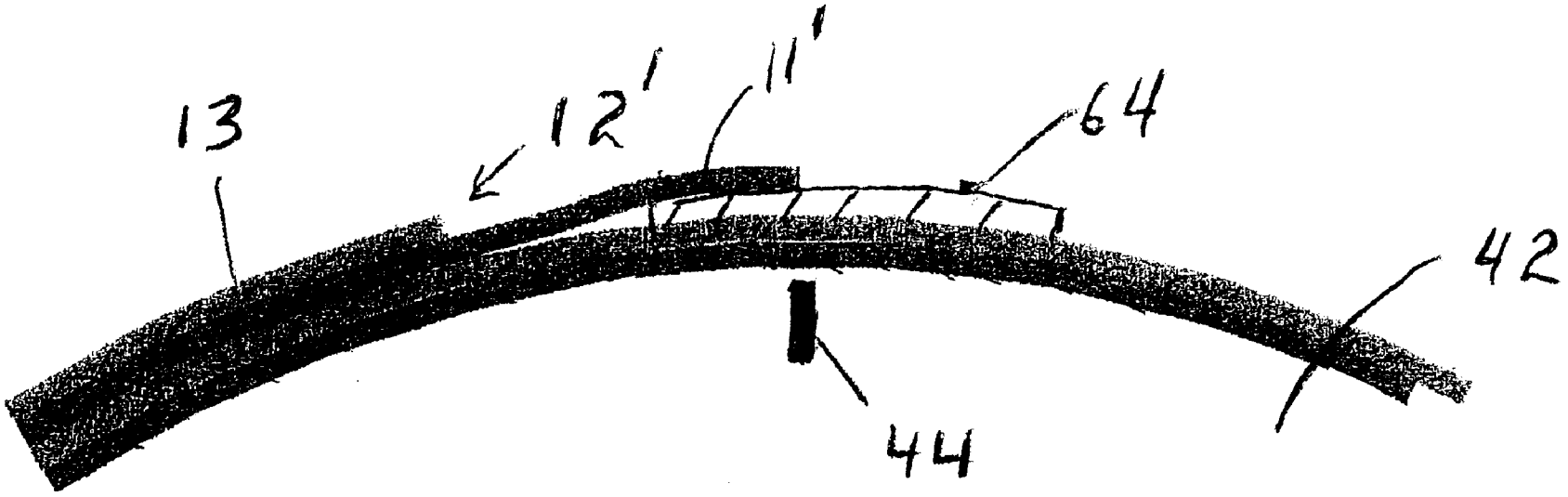
FIG. 3 is a close-up view of a prepared end of a replacement web of FIG. 1.

Referring now to FIG. 3, the preparation of the leading end of web 12' on replacement roll 42 is shown. Top web 13 is trimmed back a substantial distance from an end of liner 11. A strip of splice tape 64 is affixed half under liner 11, with its other half beyond the end of liner 11. Splice tape 64 is preferably single sided tape with its adhesive side facing upward.

It will be noted that the end of liner 11 is trimmed to align it with leading edge marker 44. In this manner, a controller controlling the overall splicing operation is updated on the location of the leading edge of liner 11 as replacement roll 42 reaches the sensing location. It is, however, not necessary that the end of liner 11 be trimmed to align with leading edge marker 44. All that is required is that the relative locations of the end of liner 11 and leading edge marker 44 be known to the control system. This is conventionally accomplished by augmenting the information from leading edge marker 44 with a rotary resolver which produces a large number of pulses per revolution of replacement roll 42. One commercially available device for producing a leading edge signal and a resolver signal is a Roto Pulser manufactured by Reliance Electric Corporation.

Figure 4:
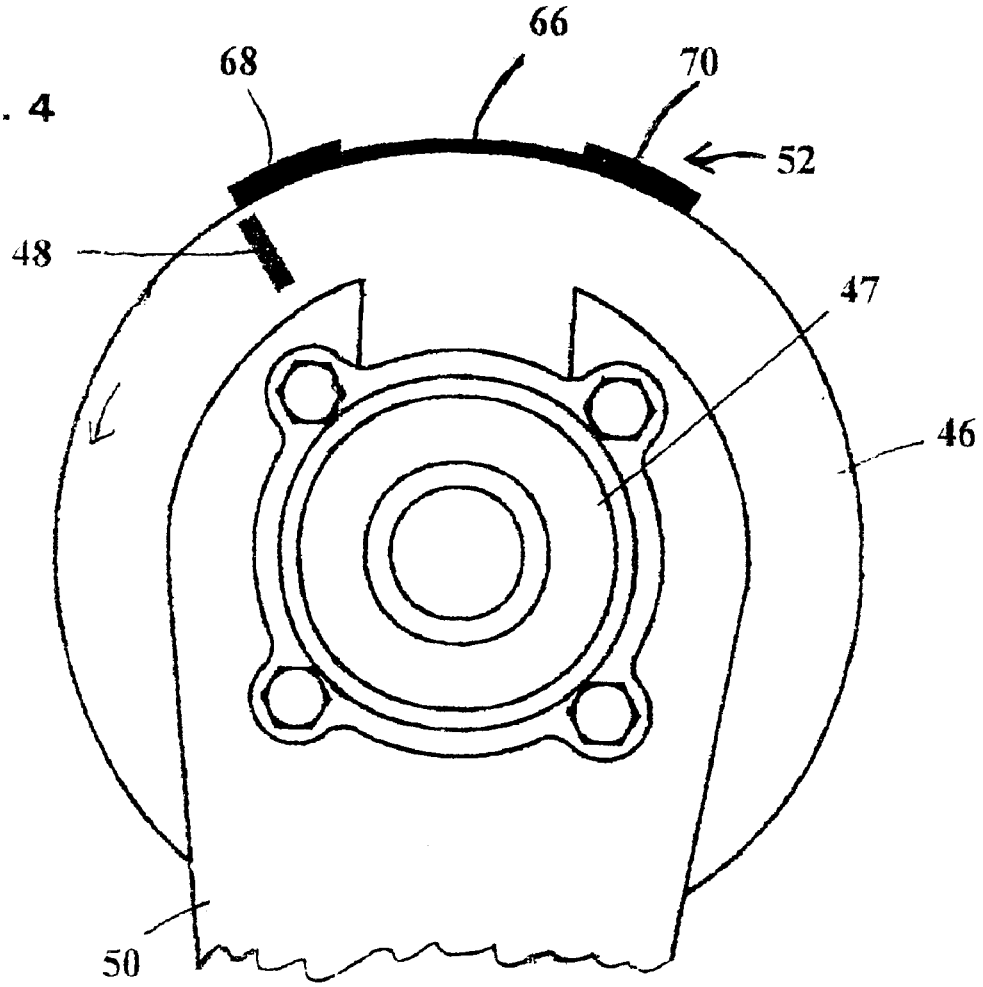
FIG. 4 is a close-up view of a splicer roll of FIG. 1.

Referring now to FIG. 4, web splice 52 includes a splice sheet 66 removably disposed on the surface of splice roll 46. Splice sheet 66 may be a strip of any convenient material, but for convenience, a strip of liner 11, or web 13, removed during preparation of two-ply web 12, as shown in FIG. 3. is conveniently at hand and may be used. Splice sheet 66 is conveniently affixed to splice roll 46 using conventional car tabs spaced along its edges which arc effective to hold splice sheet 66 in place, but which are easily torn to permit splice sheet 66 to separate from splice roll 46 during the splicing operation. Another technique for retaining splice sheet 66 in place includes making splice roll 46 as a vacuum roll which holds splice sheet 66 in place by a vacuum.

First and second double-sided adhesive strips 68 and 70 are affixed near the ends of splice sheet 66 leaving a gap between first and second double-sided adhesive strips 68 and 70.

It will be noted that web splice 52 is affixed to splice roll 46 in a position where the leading edge of web splice 52 is generally aligned with splicer leading edge marker 48.

Returning now to FIG. 1, when the time for a splice arrives, determined either by an operator input or by sensing a depleted condition of a depleting roll, replacement roll 42 and splice roll 46 are accelerated until their peripheral speeds match the speed of web 12. Using signals generated by leading edge marker 44 and splicer leading edge marker 48, the rotational phases of replacement roll 42 and splice roll 46 are coordinated so that, when severed, the cut trailing end of two-ply web 12 falls onto the exposed upper surface of splice tape 64 (see FIG. 3). As the splice proceeds, splice pneumatic cylinder 58 is actuated at the proper time to move splice roll 46 into contact with web 12. By coordinating the timing of this action, web splice 52 is affixed spanning from web 13 to web 13', thus completing the splice.

Figure 5:
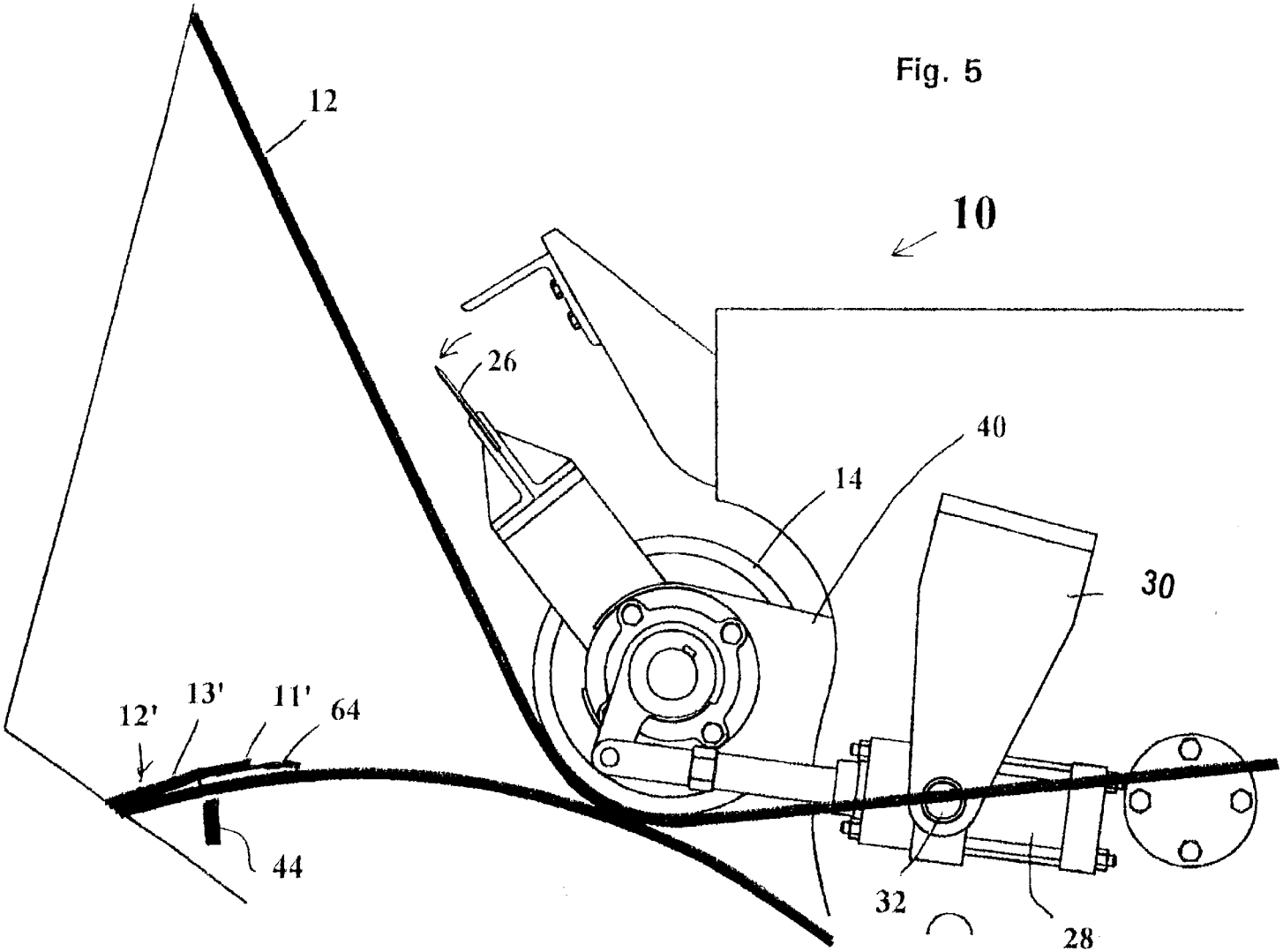
FIG. 5 is a close-up side view of a bump roll and knife just after a splice is initiated.

Referring now to FIG. 5, the condition is shown just after splicing is triggered. At this time, the peripheral speeds of web 12 and replacement roll 42 are equal. Bump roll 14 is moved into contact with the surface of replacement roll 42. Knife 26 begins its rotation toward two-ply web 12.

Figure 6:
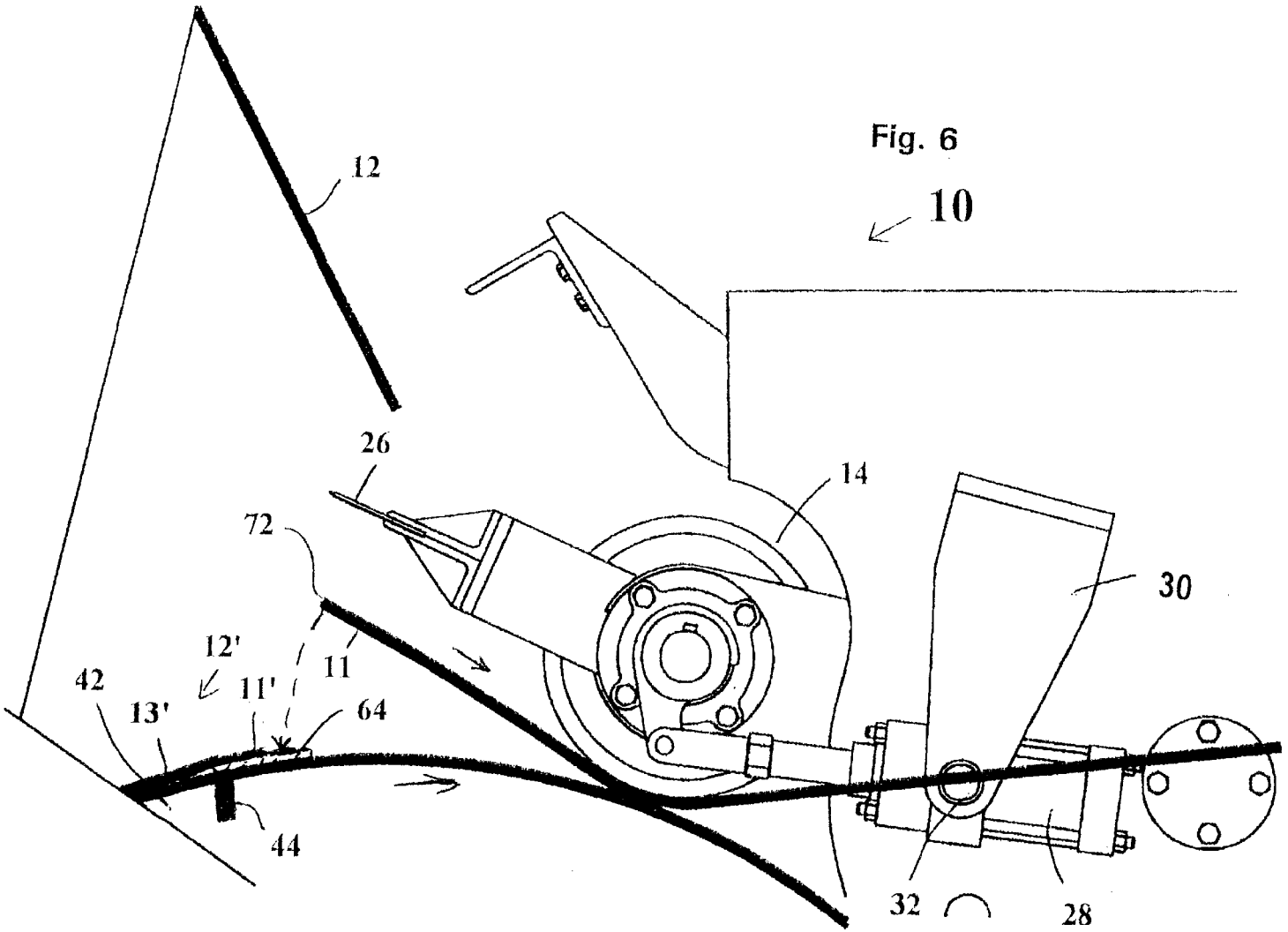
FIG. 6 is a close-up view similar to FIG. 5, except taken after the knife has severed the web.

Referring now to FIG. 6, knife 26 has continued its rotation, thereby cutting web 12 at a time which ensures that a trailing end 72 of web 12 will fall into contact with the upper surface of the uncovered portion of splice tape 64. Web 12, and the surface of replacement roll 42 continue moving at matched speed in the direction of the arrows. Bump roll 14 passes over and presses trailing end 72 firmly onto splice tape 64, thereby splicing liners 11 and 11'.

Figure 7:
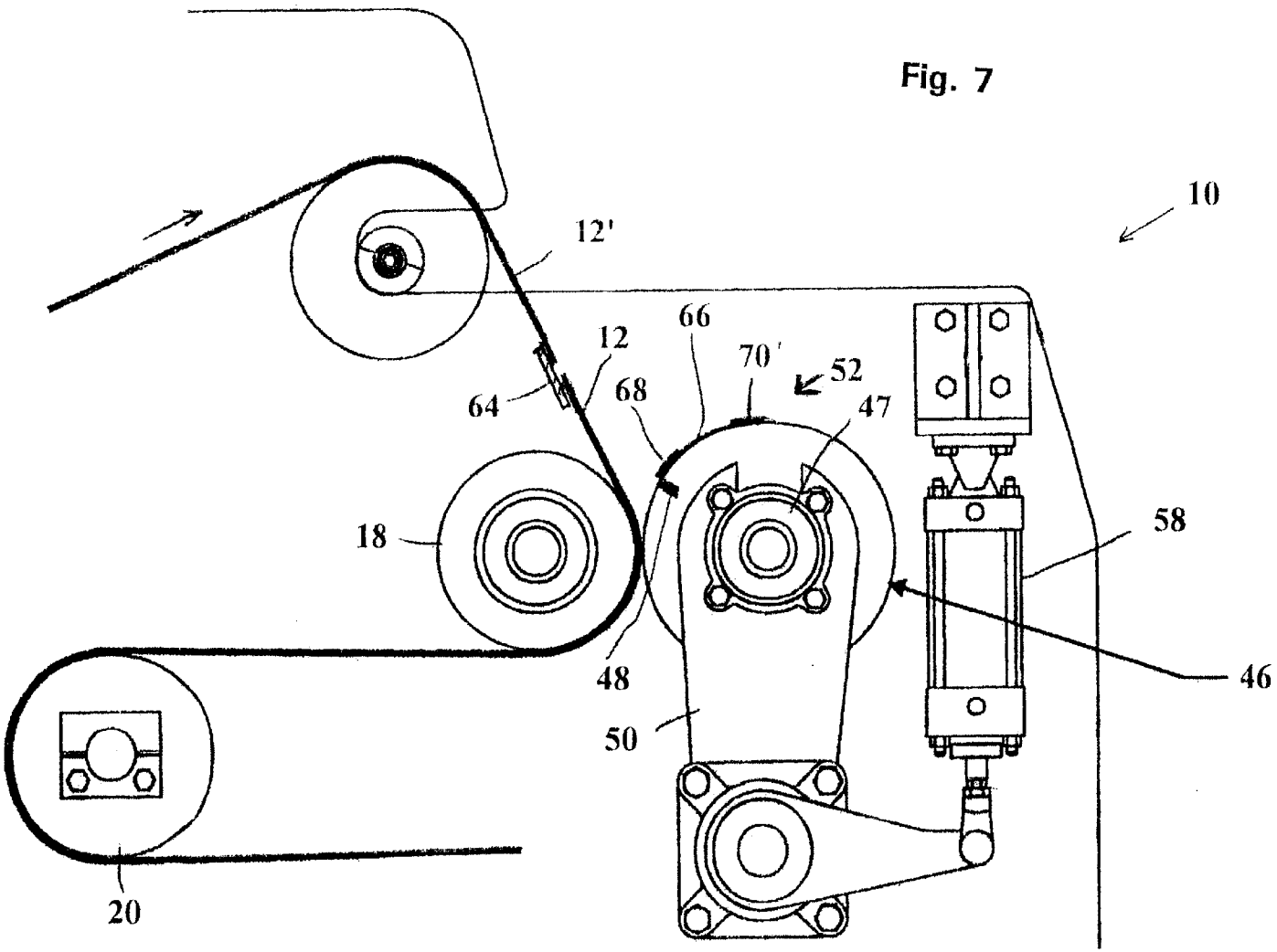
FIG. 7 is a side view of the splicer in the vicinity of the splicer roll, just before splicing is completed.
Figure 8:
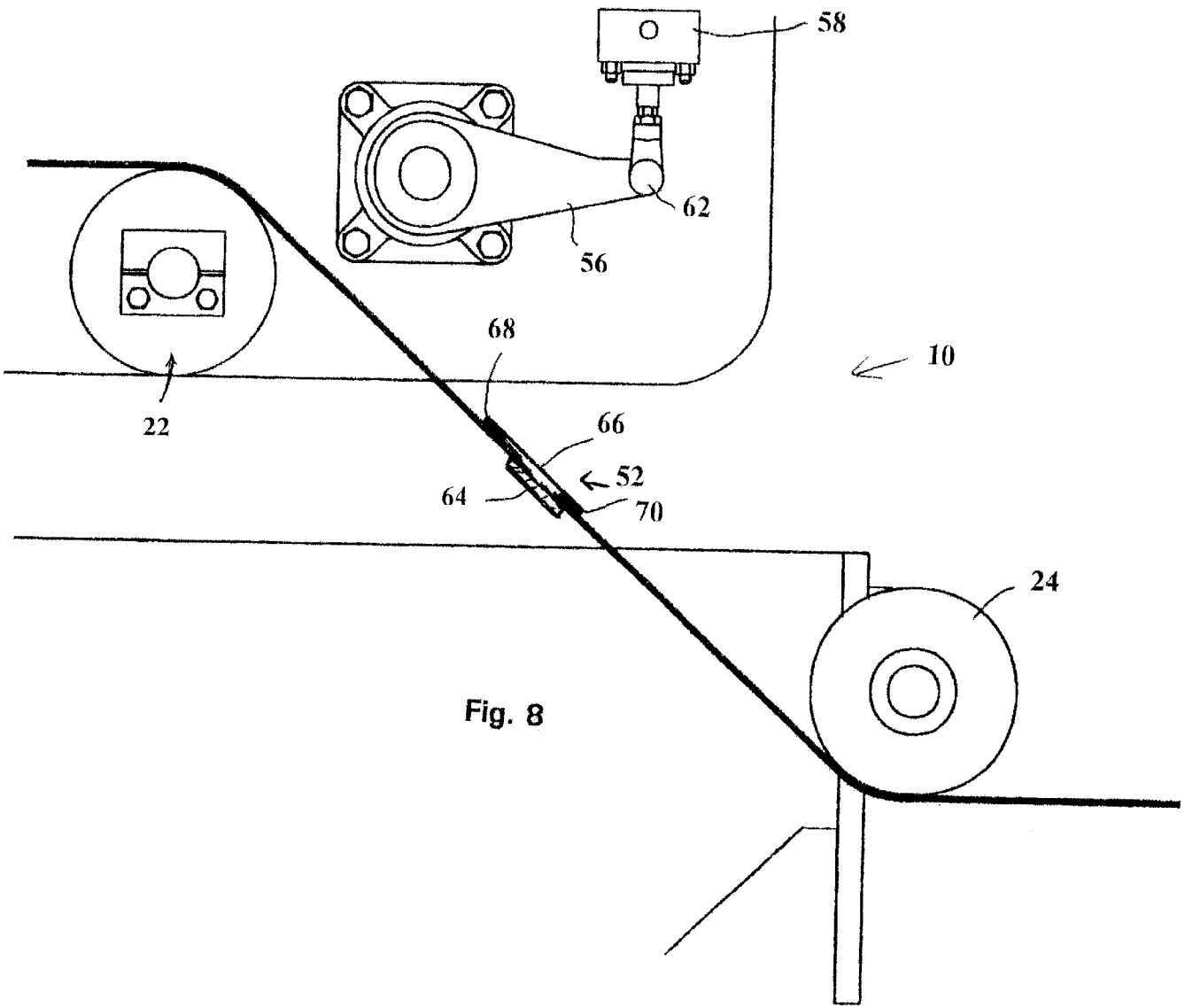
FIG. 8 is a side view of the completed splice.

Referring now to FIG. 7, the partial splice described above travels toward splice roll 46. The peripheral surface speed of splice roll 46 is equal to the speed of web 12. At the proper timing, splice roll 46 is driven by splicer pneumatic cylinder 58 into contact with web 12. The rotational phase of splice roll 46 and the timing for driving splice roll 46 into contact with web 12 is such that double-sided adhesive tape 68 contacts and is pressed into adherence with web 12, downstream of the splice, and double-sided adhesive tape 70 is pressed into adherence with web 12' upstream of the splice. Splice sheet 66 bridges the gap between adhesive tapes 68 and 70, thereby completing the splicing of both plies of webs 12 and 12'.

Upon completion of the splicing operation just described above, replacement roll 42 supplies web 12' to the using process. In subsequent operations (not shown), replacement roll 42 is rotated out of the position shown, while still supplying web 12' to the using process. A further replacement roll (not shown) is moved into the position shown for replacement roll 42. The ends of this further replacement roll are prepared as described above and, at the proper time a further splice is made to continue the supply operation.

Figure 9:
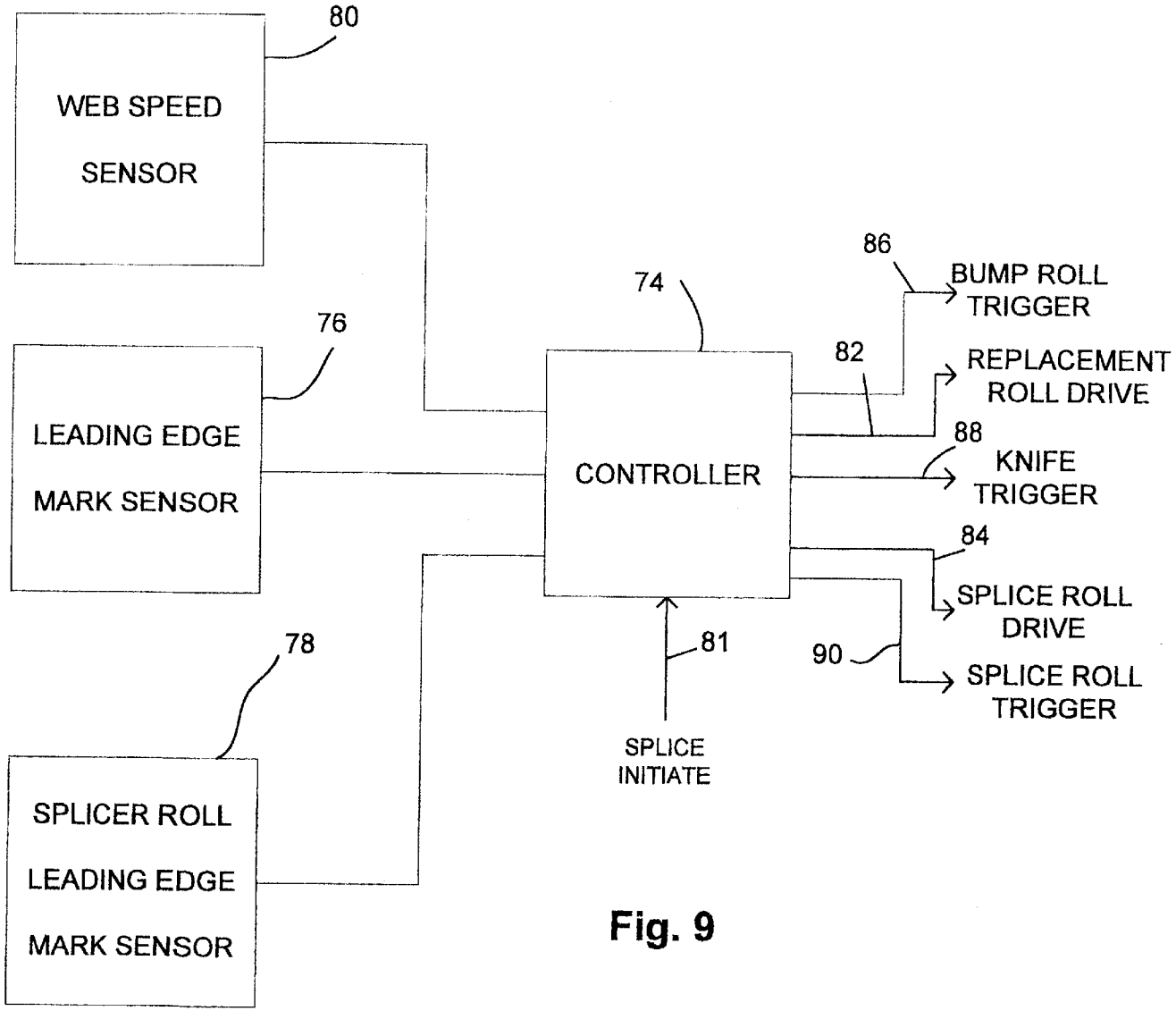
FIG. 9 is a logic diagram of a control system for the apparatus of FIGS. 1–8.

Referring now to FIG. 9, a controller 74 receives an input from a leading edge marker sensor 76 which responds to the passage past its sensing location of leading edge marker 44. Controller 74 also receives an input from a splicer leading edge mark sensor 78, which responds to passage past its sensing location of splicer leading edge marker 48. Controller 74 receives a speed input from a web speed sensor 80. Controller 74 also receives a splice initiate signal on a line 81. The origin of the splice initiate signal can be a manual input from an operator, or an automatic input from a roll size or web length sensor which responds to a predetermined level of depletion of the web from a supplying roll.

Controller 74 provides outputs on lines 82 and 84 for controlling the speeds and phases of replacement 42 and splicer roll 46. Controller 74 generates a bump roll trigger on a line 86 for initiating the movement of bump roll 14 toward the surface of replacement roll 42. Controller 74 generates a knife trigger signal on a line 88 for beginning the rotation of cut-off knife 26 toward the web moving through splicer 10. Controller 74 generates a splicer roll trigger on a line 90 for initiating the movement of splicer roll 46 toward the web.

When a splice initiate signal is received on line 81, the outputs on lines 82 and 84 accelerate their respective rolls to match the web speed signal from web speed sensor 80, and adjust the respective times at which the two leading edge signals are received. Once matched speed and predetermined relative phases of the leading edges markers of replacement roll 42 and splicer roll 46 are attained, controller 74 produces the bump roll trigger signal on line 86 and the knife trigger signal on line 88. After a predetermined time delay from the generation of the signals on lines 86 and 88, controller 74 produces a splicer roll trigger signal on line 90 to urge splicer roll 46 into contact with the web moving therepast. The time delay is selected to make contact just before web splice 52 is rotated into contact with the web. That is, the leading double-sided adhesive strip 68 is moved to make contact with the web downstream of the splice, and the trailing double-sided adhesive strip 70 is moved to make contact with the web upstream of the splice, with splice sheet bridging the gap between the two adhesive strips 68 and 70.

Although separate trigger signals are shown on lines 86 and 88 for controlling bump roll 14 and knife 26, respectively, it may be sufficient to produce a single trigger signal to control both of these functions, since both functions are closely related in time.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A web splicer for on-the-fly splicing of a leading edge of a replacement web with a web comprising:

said replacement web being wound on a replacement roll movable into a position spaced from a first surface of said web;

a bump roll at a second surface of said web;

a cut-off knife;

means for matching a speed of a peripheral surface of said replacement roll with a speed of said web;

means for urging said bump roll into contact with said web, and for severing said web at a timing whereby urging said web into contact with said replacement roll affixes a splice tape at a trailing end of said web, where severed, in joining contact with said first surface of a leading edge of said replacement web, whereby a first surface of said web is spliced to a first surface of said replacement web;

a splice roll;

said splice roll being adapted for the attachment thereto of a splice sheet with first and second spaced-apart adhesive strips affixed thereto;

means for urging said splice roll into contact with a second surface of said web; and means for controlling a rotational speed and a phase of said splice roll, with respect to said replacement roll, and a timing of urging said splice roll into contact with said web, to affix said first adhesive strip to said second surface downstream of said trailing edge, and to affix said second adhesive strip to said second surface upstream of said leading edge, with said splice sheet bridging a gap between said first and second adhesive strips, whereby first and second sides of said web are spliced to corresponding sides of said replacement web.

2. Apparatus according to claim 1, wherein:

said web and said replacement web are each two-ply webs each having a first layer and a second layer;

said splice tape being affixed to said first layer of said web and said first layer of said replacement web; and said first adhesive strip and said second adhesive strip being attached to said second layer of said web and said replacement web, respectively, with said splice sheet bridging the gap therebetween, whereby both said first layer of said web and said replacement web, and said second layer of said web and said replacement web are independently spliced to each other.

3. Apparatus for splicing a replacement web to a web, wherein said web and said replacement web each includes first and second plies comprising:

first means for splicing said first ply of said web and said replacement web together;

second means for splicing said second ply of said web and said replacement web together;

said second means being disposed downstream of said first means; and said first means and said second means being operable to perform said splicing while said web is in motion, whereby a processing speed of said web is improved.

4. Apparatus according to claim 3, wherein:

said first means includes an adhesive splice tape splicing said first ply of said web to said first ply of said replacement web; and said second means includes a first adhesive strip affixable to said second ply of said web, a second adhesive strip affixable to said second ply of said replacement web, and a splice sheet bridging between said first and second adhesive strips.

5. A method for splicing a replacement web on a replacement roll to a moving web, wherein said replacement web and said web both include first and second plies, comprising:

preparing a leading edge of said replacement web by trimming back an outermost portion of said second ply, which exposes an upper surface of said first ply;

fixing a strip of splice tape partly below said first ply, and partly uncovered by said first ply, whereby an adhesive portion of said strip is exposed;

preparing a web splice by affixing first and second adhesive strips spaced apart on a splice sheet;

affixing said web splice to a splice roller adjacent said moving web, with said first and second adhesive strips facing outward;

accelerating said replacement roller to a peripheral speed substantially matching a speed of said moving web;

urging said web against said replacement roller, and severing said moving web at a time effective for affixing said strip of splice tape to a severed trailing edge of said web, whereby said first ply of said web is spliced to said first ply of said replacement web;

accelerating said splice roller to a peripheral speed substantially matching a speed of said moving web;

adjusting a rotational phase of said splice roller;

urging said splice roller into contact with said web at a timing which affixes said first adhesive strip downstream of said trailing edge, and affixes said second adhesive strip upstream of said leading edge, with said splice sheet bridging a space between said first and second adhesive strips, whereby said second plies of said web and said replacement web are spliced to each other.

* * * * *